US006826818B2

(12) United States Patent
Sax et al.

(10) Patent No.: US 6,826,818 B2
(45) Date of Patent: Dec. 7, 2004

(54) FENCE CONSTRUCTION SYSTEM FOR BUILDING A FENCE WITH A WALL APPEARANCE AND CHARACTERISTICS AND METHOD FOR BUILDING SUCH A FENCE

(75) Inventors: Edward Sax, 1030 Arabian Dr., Loxahatchee, FL (US) 33470; Paul Dearaujo, Royal Palm Beach, FL (US); Walter Shealy, III, Wellington, FL (US)

(73) Assignee: Edward Sax, Loxahatchee, FL (US)

( * ) Notice: Subject to any disclaimer, the term of this patent is extended or adjusted under 35 U.S.C. 154(b) by 0 days.

(21) Appl. No.: 10/386,964

(22) Filed: Mar. 12, 2003

(65) Prior Publication Data

US 2003/0155567 A1 Aug. 21, 2003

Related U.S. Application Data

(63) Continuation-in-part of application No. 10/076,978, filed on Feb. 15, 2002.

(51) Int. Cl.[7] ..... B21F 27/20

(52) U.S. Cl. ..... 29/460; 29/897.32; 256/24; 256/32; 256/37; 52/223.6; 52/223.14

(58) Field of Search ..... 256/19, 32, 33, 256/37, 40, 41, 45, 1, 24; 52/222, 223.1, 223.6, 223.14; 428/294.7; 29/460, 464, 897.3, 897.32

(56) References Cited

U.S. PATENT DOCUMENTS 355,135 A * 12/1886 Bunch ..... 256/37 X
4,031,285 A * 6/1977 Miller et al.
6,355,333 B1 * 3/2002 Waggoner et al.

* cited by examiner

*Primary Examiner*—Gregory J. Binda
*Assistant Examiner*—Ryan M. Flandro
(74) *Attorney, Agent, or Firm*—Laurence A. Greenberg; Werner H. Stemer; Ralph E. Locher

(57) ABSTRACT

A fence construction system and a method for building such a fence are provided. The fence looks like a wall and has wall characteristics, such as a post-tension condition, but is much less expensive and easier to build. The method includes the steps of erecting a plurality of fence posts including two end fence posts, erecting two stressing posts within and closely adjacent the two end fence posts, placing a respective spacer between each stressing post and the adjacent end post, stringing a plurality of high-tension tensile wires between the two end posts, tensioning the high-tension tensile wires, securing the high-tension tensile wires to the fence posts, securing wire lath to the pre-stressed high-tension tensile wires and fence posts, applying fence coating material to the wire lath, cutting the high-tension tensile wires between the end fence posts and the stressing posts, and removing the spacers.

34 Claims, 6 Drawing Sheets

FENCE CONSTRUCTION SYSTEM FOR BUILDING A FENCE WITH A WALL APPEARANCE AND CHARACTERISTICS AND METHOD FOR BUILDING SUCH A FENCE

CROSS-REFERENCE TO RELATED APPLICATION

This is a continuation-in-part of application Ser. No. 10/076,978, filed Feb. 15, 2002.

BACKGROUND OF THE INVENTION

1. Field of the Invention

The present invention relates to a fence construction system for building a fence and a method for building a fence. More particularly, the invention relates to a fence construction system for building a fence that looks like a wall and a method of using such a fence construction system to build the fence. The fence construction system and method of the present invention are very easy to use and can build fences inexpensively with an elegant wall appearance and additional security.

This application is an improvement of the invention of copending application Ser. No. 10/076,978. Application Ser. No. 10/076,978 describes a fence construction system in which a ratcheting stressing system is used. The ratcheting stressing system uses ratcheting posts disposed beyond the fence end posts for stressing the high-tension tensile wires. This system works well if there is large open space. However, when the space is limited, the ratcheting posts may interfere with neighboring property. In order to solve this problem, the present application provides an internal stressing system in which the stressing posts form a part of the fence and therefore is advantageous when used in a limited space.

2. Description of Related Prior Art

Williams (U.S. Pat. No. 3,869,530) teaches a procedure for constructing circular concrete walls in sectors. Tension is applied to peripheral reinforcing rods in the sectors to a desired degree of pre-stress after the concrete sets. The pre-stressed reinforcing rods are then grouted through the use of hollow rods and vented couplings.

Dawson (U.S. Pat. No. 5,501,057) teaches a unit masonry fence and a method for its installation. The unit masonry fence has footings, support posts extending upwardly from the footings and prefabricated fence panels mounted over the support posts.

Loggy (U.S. Pat. No. 4,597,925) teaches a method of constructing a modular reinforced concrete building with roof metal lath.

Ballentine (U.S. Pat. No. 167,973) teaches a wall construction of buildings in which a composition for artificial stone is filled in the space between strips on both sides of the posts. No pre-stress or post tensioning is used in the construction.

Deslauriers (U.S. Pat. No. 520,137) teaches a fireproof and slow burning building wall with a sheet metal covering. Metallic studs, horizontal angle bars and wire laths underneath the bars constitute a metallic framework. No pre-stress or post tensioning is used in the construction.

Watkins (U.S. Pat. No. 5,894,704) teaches a bearing wall construction process without removable forms wherein a reinforcing screen is encased within concrete during a concrete blowing step.

Nelson (U.S. Pat. No. 4,365,451) teaches a poured adobe building construction and a method for forming the same.

Hopman (U.S. Pat. No. 4,366,657) teaches a method and a form for mechanically pouring adobe structures.

Waggoner et al. (U.S. Pat. No. 6,355,333 B1) teaches a construction membrane that resists liquid and air penetration.

All of the above-mentioned references relate basically to the construction of walls for buildings, which require high supporting ability. These wall constructions are basically formed by pouring concrete, adobe or other material within forms or formed by prefabricated bricks or stones, which are very complicated and are very expensive to construct. None of them is constructed specifically for the purpose of building a fence with a wall appearance and characteristics at low cost.

Although Spillinger (U.S. Pat. No. 485,304) teaches a fence construction, it does not teach a stressing system that can create post-tension or compression condition in the fence. The advantage of post-tension or compression is that the fence can be built with extra strength and length. Especially, Spillinger does not teach an internal stressing system which can be advantageously used in limited space.

SUMMARY OF THE INVENTION

It is accordingly an object of the present invention to provide a fence construction system, and a method for building such a fence, which overcome the above-mentioned deficiencies.

Another object of the present invention is to provide a fence construction system with an internal stressing system and a method for building a fence using such system, which can be used in limited building space.

Still another object of the present invention is to provide a fence construction system with an internal stressing system and a method for building a fence using such system, which can easily adjust the tension in the high-tension tensile wires in order to provide substantial equal tension in each high-tension tensile wire.

In one aspect, the present invention relates to a method for constructing a fence with a wall appearance and characteristics, which comprises the steps of:

- erecting a plurality of fence posts including two end fence posts;
- erecting two stressing posts within and closely adjacent the two end fence posts;
- placing a respective spacer between each stressing post and the adjacent end post;
- stringing a plurality of high-tension tensile wires between the two end posts;
- tensioning the high-tension tensile wires;
- securing the high-tension tensile wires to the fence posts;
- securing wire lath to the pre-stressed high-tension tensile wires and fence posts;
- applying fence coating material to the wire lath;
- cutting the high-tension tensile wires between the end fence posts and the stressing posts; and
- removing the spacers.

In accordance with another feature of the invention, the method further comprises providing each high-tension tensile wire with a spring and a tensioner at an end thereof and tensioning the high-tension tensile wires with the tentioners.

In accordance with another feature of the invention, the spring and the tensioner in each high-tension tensile wire are disposed between at least one of the stressing posts and the adjacent end fence post.

In accordance with another feature of the invention, the method further comprises placing a strip at an outer side of each end post.

In accordance with another feature of the invention, the method further comprises providing the strips with a plurality of studs and stringing the plurality of high-tension tensile wires between the studs.

In accordance with another feature of the invention, the strips are formed as a metal channel wrapped around the outer side of each end post.

In accordance with another feature of the invention, the strips are formed as a metal panel placed against the outer side of each end post.

In accordance with another feature of the invention, the studs are formed on at least one of a front and a back side of the strips.

In accordance with another feature of the invention, the method further comprises cutting the high-tension tensile wires between the stressing posts and the tensioners.

In accordance with another feature of the invention, the method further comprises applying wires and wire lath between the end posts and the stressing posts.

In accordance with another feature of the invention, the method further comprises applying fence coating material to the wire lath between the end posts and the stressing posts.

In accordance with another feature of the invention, the method further comprises forming the stressing posts as pilasters after completion of the fence construction.

In accordance with another feature of the invention, the method further comprises securing the wire lath to the high-tension tensile wires with fastener clips.

In accordance with another feature of the invention, the method further comprises performing the step of applying fence coating material to the wire lath by:

applying a scratch coat to the wire lath;

applying a brown coat to the surface of the scratch coat; and applying a finish coat to the surface of the brown coat.

In accordance with another feature of the invention, the method further comprises providing crack control joints between the brown coat and the finish coat.

In accordance with another feature of the invention, the method further comprises providing expansion joints for long fence walls or fence walls with corners/bends.

In another aspect, the present invention relates to a fence construction system, comprising:

a plurality of fence posts including end fence posts;

at least two stressing posts disposed within and closely adjacent the end fence posts;

a removable spacer provided between the end fence posts and the adjacent stressing posts;

a plurality of high-tension tensile wires running between and secured to the end posts;

a tensioner disposed at each high-tension tensile wire for tensioning the high-tension tensile wires;

a wire lath secured to the plurality of high-tension tensile wires and the fence posts; and the high-tension tensile wires being cut between the end fence posts and the stressing posts compressing the wire lath.

In accordance with another feature of the invention, the fence construction system further comprises strips each disposed against the outer side of a respective one of the stressing posts.

In accordance with another feature of the invention, the strips have a plurality studs formed thereon and the studs extend perpendicularly to a fence surface.

In accordance with another feature of the invention, the strips are formed as a metal channel wrapped around an outer side of each stressing post.

In accordance with another feature of the invention, the strips are U-shaped.

In accordance with another feature of the invention, the strips are L-shaped.

In accordance with another feature of the invention, the strips are formed as a metal panel placed against an outer side of each stressing post.

In accordance with another feature of the invention, the fence construction system further comprises a strengthening bar attached between said U-shaped channel and said spacer.

In accordance with another feature of the invention, the strengthening bar has two notches for attaching to a stud on said U-shaped channel and a stud on said spacer.

In accordance with another feature of the invention, the spacer is a rectangular metal frame.

In accordance with another feature of the invention, the spacer is a metal plate with two flanges.

In accordance with another feature of the invention, the metal plate further has a supporting bar attached thereto.

In accordance with another feature of the invention, the fence construction system further comprises a fence coating applied to said wire lath, said cut high-tension tensile wires compressing the fence coating together with the wire lath.

In accordance with another feature of the invention, the fence coating includes a scratch coat applied to the wire lath, a brown coat applied to the scratch coat and a finish coat applied to the brown coat.

In accordance with another feature of the invention, the fence construction system further comprises a paint applied on the fence coating.

In accordance with another feature of the invention, the paint is one of a prime coat and a color coat.

In accordance with another feature of the invention, the fence construction system further comprises an adaptor attached to an upper part of a higher fence post upon an elevation difference occurring between the fence posts.

In accordance with another feature of the invention, the adaptor has plurality of studs for attaching the high-tension tensile wires and is attached to the fence post.

Additional objects and advantages of the invention will be set forth in part in the description which follows, and in part will be clear from the description, or may be learned by practice of the invention. The advantages of the invention will be realized and attained by the elements and combinations particularly pointed out in the appended claims. It is to be understood that both the foregoing general description and the following detailed description are exemplary and explanatory only and are not restrictive of the invention, as claimed.

DETAILED DESCRIPTION OF THE PREFERRED EMBODIMENTS

The present invention may be understood more readily by reference to the following detailed description of preferred embodiments of the invention.

Before the present invention is disclosed and described, it is to be understood that the terminology used herein is for the purpose of describing particular embodiments only and is not intended to be limiting. It must be noted that, as used in the specification and the appended claims, the singular forms "a," "an" and "the" include plural references unless the context clearly dictates otherwise.

The present invention will now be described in detail with reference to the accompanying drawings.

Figure 1:
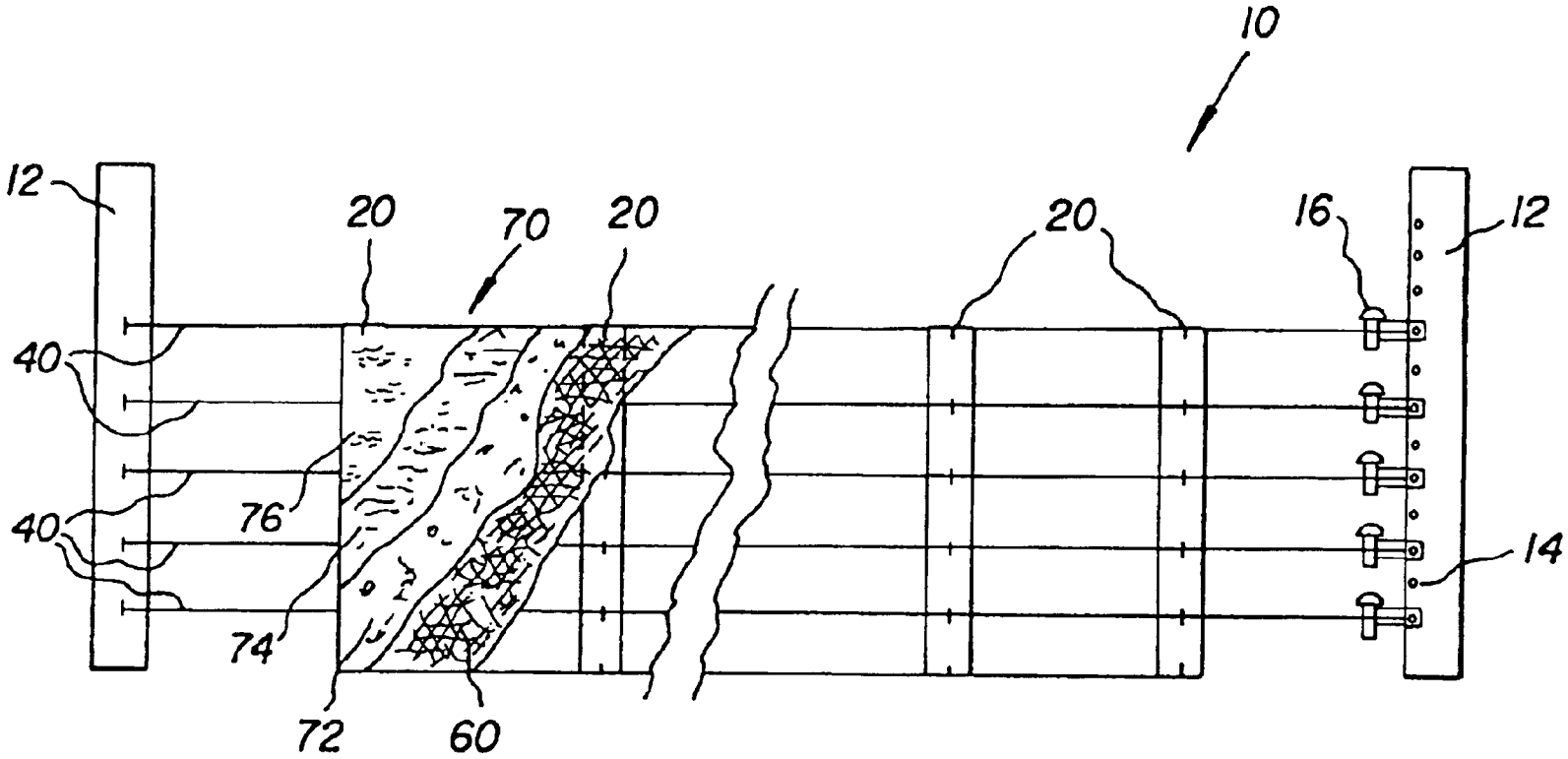
FIG. 1 is a diagrammatic, front-elevational view of the fence construction system with a temporary ratcheting stressing system.

Referring now to the figures of the drawings in detail and initially to FIG. 1, there is diagrammatically shown a representative fence construction system, which is described in copending application Ser No. 10/076,978, filed Feb. 15, 2002 and generally designated by reference numeral 10. Before beginning the construction of the fence, a survey must be conducted to decide the size, the height and the configuration of the fence, according to which the fence layout and post locations are then decided and marked. Post holes are dug at the post locations. Fence posts 20 are then placed into the post holes. The number and the size of the fence posts and the distance between the fence posts are determined by the dimensions and configuration of the fence. The fence posts are then plumbed, aligned to the layout of the fence and secured in the post holes. Two ratcheting posts 12 are installed beyond the two end fence posts. One of the ratcheting posts 12 has a plurality of holes 14 on two opposite side faces (only one side is shown) of the ratcheting post 12 for the assembly of ratchets 16. The number of ratchets depends on the number of high-tension tensile wires to be used, which in turn depends on the customers' requirement and the local government regulations. A plurality of high-tension tensile wires 40 are strung between the two ratcheting posts 12 at one side or both sides of the fence posts 20. One end of each wire is fixed to one ratcheting post 12 and the other end is attached to a ratchet 16 on the other ratcheting post. The high-tension tensile wires 40 (e.g. A102 Superlife 12 HT wire) are tensioned by turning the ratchets clockwise to a certain torque and then are secured to the fence posts 20 by staples, clips or any other fasteners.

Figure 2:
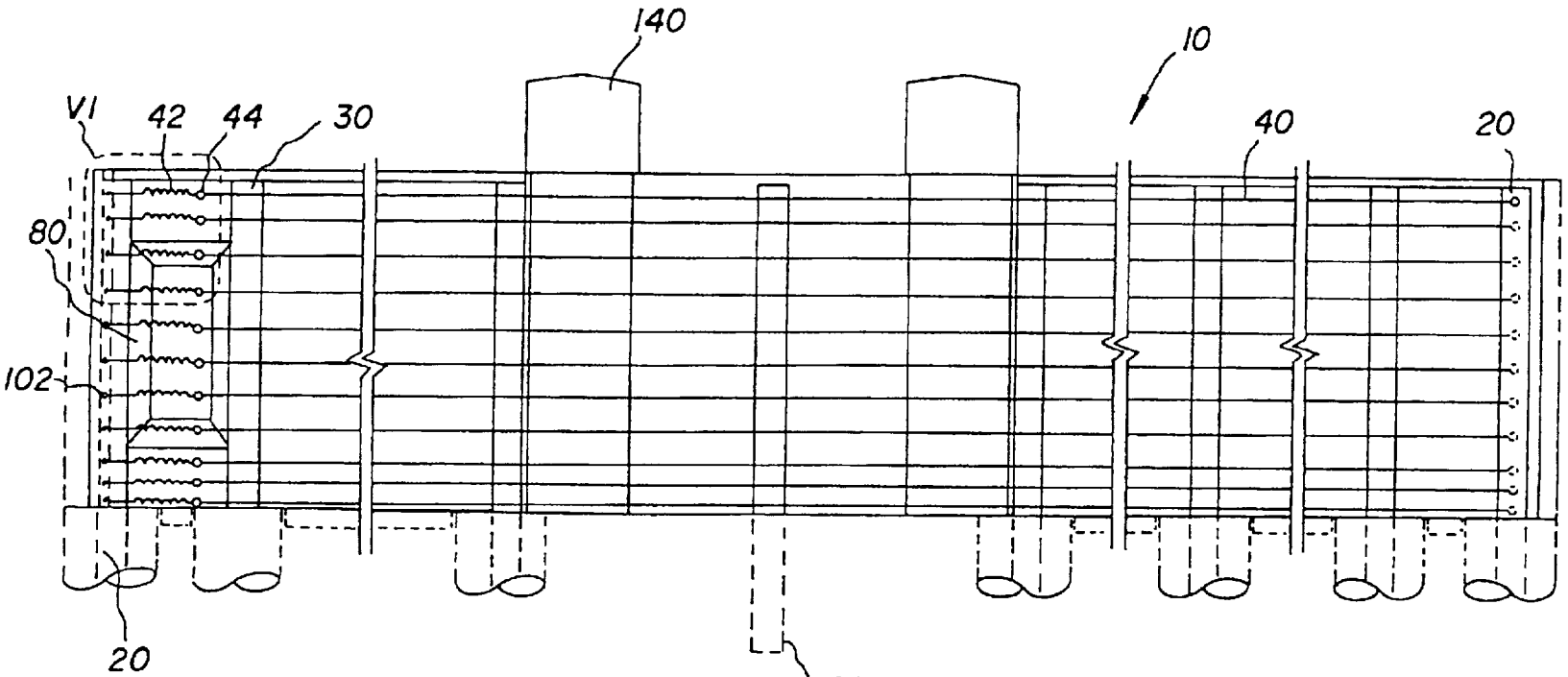
FIG. 2 is a front-elevational view of the fence construction system with an internal stressing system.
Figure 3:
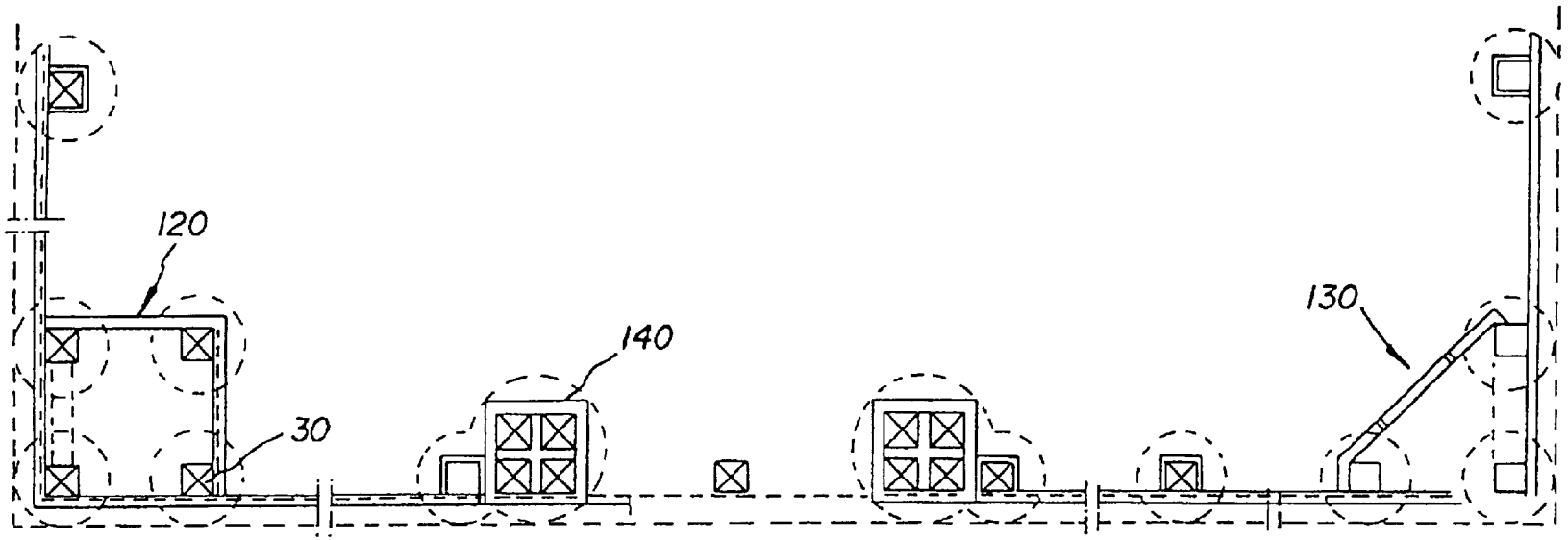
FIG. 3 is a top-plan view of the fence construction system of FIG. 2, showing a single sided fence wall with the stressing end posts forming a rectangular or a triangle pilaster at the corner of the fence.

The ratcheting stressing system according to FIG. 1 with ratcheting posts disposed beyond the fence end posts for stressing works well if there is large open space. However, when the space is limited, the ratcheting posts may interfere with neighboring property. In order to solve this problem, an internal stressing system is provided. As shown in FIGS. 2 and 3, two stressing posts 30 are added inside the end fence posts 20 at two ends of the fence wall and form a part of the fence wall after completion of the construction. The stressing posts could be the same wood posts as the fence posts 20. As shown in FIGS. 6–9, a metal strip which may be a U-shaped channel (or bracket) 100, an L-shaped channel 100' (used at the corner of the fence) or a flat panel 100" with a plurality of studs 102 on the front (or also on the back) side of the channel or panel, wraps around or is placed against the outer side of the end fence posts 20. The metal channel 100, 100' or panel 100" is nailed by nails 104 on its front or back or side to the end fence post. The studs 102 extend outwardly from the front (or also the back) side of the metal channel or panel for attachment of the high-tension tensile wires 40. The high-tension tensile wires may also be directly nailed to the stressing posts.

A temporary guide post 180 is used to prevent sagging of the tensile wires 40 within a large gate opening and is removed after the wires are cut.

Figure 12:
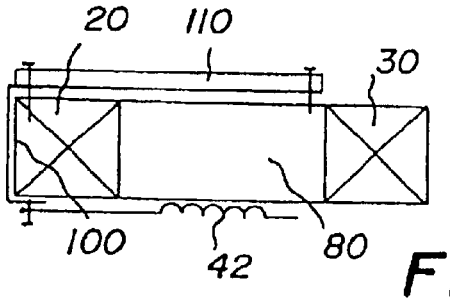
FIG. 12 is a top-plan view of the stressing end post together with the adjacent end fence post and the spacer disposed therebetween, showing the temporary supporting bar attached at the back of the fence between the metal channel and the spacer for a single sided wall.
Figure 13:
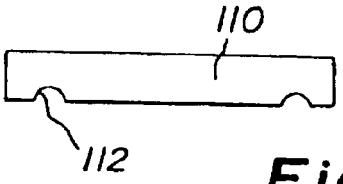
FIG. 13 is an enlarged view of the supporting bar as shown in FIG. 12.
Figure 14:
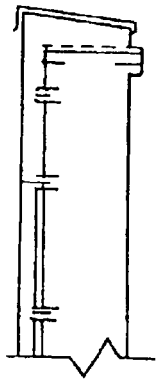
FIG. 14 is partial side-elevational view showing a roofing structure of the fence.

As shown in FIGS. 12—13, in order to prevent the L-shaped channel 100 from detaching from the end fence post when used for single sided wall, an additional supporting bar 110 is provided. The supporting bar 110 has two notches 112 for connecting with studs on the channel 100 and on the spacer 80.

In order to stress the high-tension tensile wires 40, a spring 42 (e.g. an inline spring) and a tensioner 44 (e.g. A300 spring clip tightener by West Virginia Fence Corporation) are connected to each high-tension tensile wire 40 at one end thereof between the stressing post 30 and the corresponding stud 102 on the metal channel 100, 100' or panel 100". Each wire is initially tightened by the tensioner 44 to about 50 lbs of tension to ensure that the wire is straight, and is then further stressed to the required tension.

The advantage of using a spring 42 and a tensioner 44 for each high-tension tensile wire 40 is that the tension in each wire can be easily adjusted and all the wires 40 can be stressed with equal tension.

Figure 4:
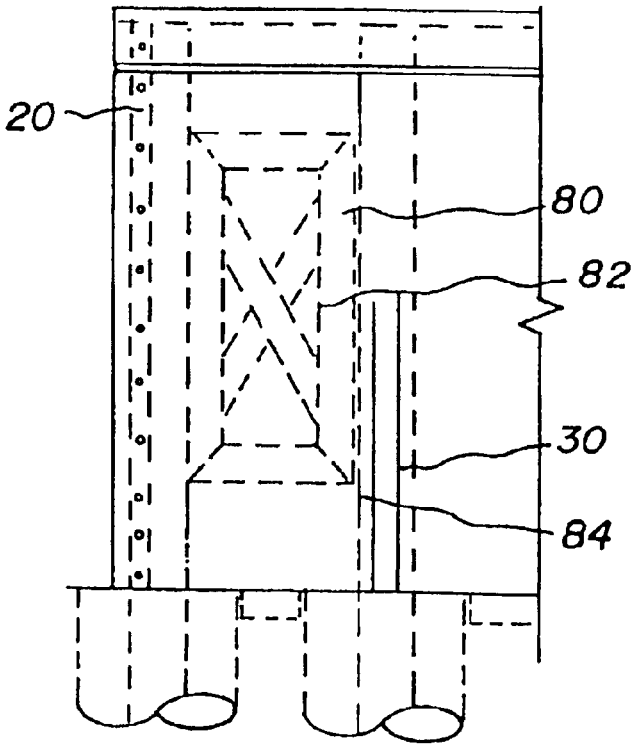
FIG. 4 is a front-elevational view showing a first embodiment of the spacer between the stressing end post and the fence post adjacent the same.
Figure 5:
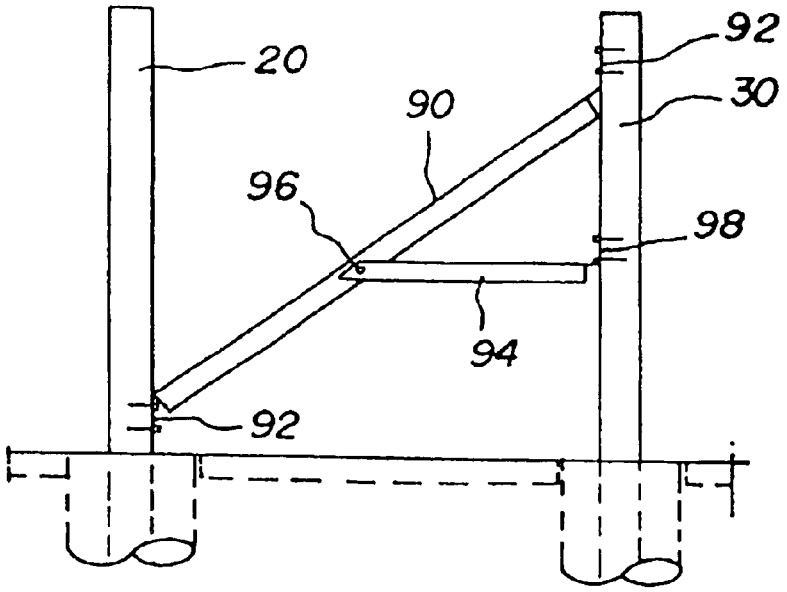
FIG. 5 is a front-elevational view showing a second embodiment of the spacer between the stressing end post and the fence post adjacent the same.
Figure 6:
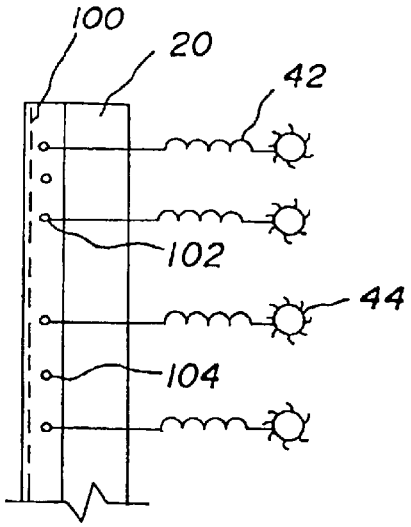
FIG. 6 is an enlarged view of a part VI of FIG. 2, showing the end fence post and the springs attached thereto.
Figure 7:
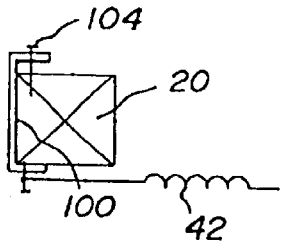
FIG. 7 is a top-plan view of the end fence post, showing the temporary U-shaped metal channel, nailed on the outer side of the end fence post, with studs for attaching the wires.
Figure 8:
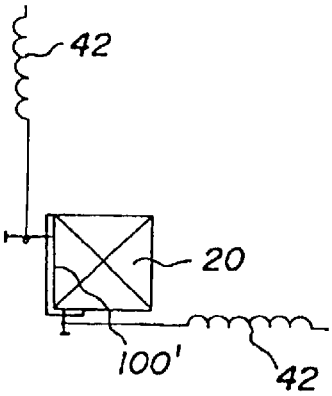
FIG. 8 is a top-plan view of the end fence post, showing the temporary L-shaped metal channel for use at the corner of two fence walls.

In order to prevent the end fence post 30 from inclining, a spacer can be installed between each stressing post 30 and the adjacent end post 20. FIG. 4 shows one embodiment of the spacer, in which a rectangular metal frame 80 is disposed between the stressing post 30 and the end post 20, with a size matching the distance therebetween. The steel frame 80 is fixed to the posts by screws 82 and 84. FIG. 5 shows another embodiment of the spacer, in which a metal plate 90 with two flanges 92 is disposed between the stressing post 30 and the end post 20. The metal plate 90 is fixed to the posts by screwing through the flanges 92. An additional supporting bar 94, which is connected to the metal plate 90 by a bolt 96 and attached to the stressing post 30 by screwing through the flange 98 can be used to further strengthen the spacer.

After the high-tension tensile wires 40 are stressed to the required tension, wire lath(s) 60 (see FIG. 1) can then be secured to one side (or both opposite sides, if necessary) of the fence posts 20 and to the tensioned tensile wires 40 by nails or staples. The wire laths can be galvanized metal or plastic.

The fence posts and stressing posts can also be metal. When metal posts are used, the high-tension tensile wires 40 and wire lath(s) 60 are fastened to the posts by clips or other fasteners.

Fence coating material 70 can then be applied to the surface of the wire lath. The WONDERTEC™ coating material produced by Wondertec International, Inc. is especially suitable for building the fence construction according to the present invention. Alternatively, other coating material (such as ASTM A 854-94 with a minimum strength requirement of 1800 PSI) can also be used. Typically, the coating material 70 includes three coating layers 72, 74 and 76 (see FIG. 1). First, a scratch coat 72 (e.g. Portland cement mixture with polymers, various fiber particles and selected sizes of aggregate) is applied with potable water to the wire lath. Then a brown coat 74 of the same mixture is applied to the surface of the scratch coat. At last a finish coat 76 (e.g. texture coat of choice) is applied to the surface of the brown coat. The thickness of the scratch coat layer and the brown coat layer are about ⅜ inch.

Since the tension in the high-tension tensile wires 40 may change the initial stressing due to weather conditions, it is necessary to verify and adjust the tension in the high-tension tensile wires prior to the application of the scratch coat 72.

After forming the coating, the tensioned high-tension tensile wires 40 are cut between the end fence post 20 and the tensioner 44 to create a post-tension and compression condition in the fence construction. The end fence posts and coating are touched up where the high-tension tensile wires were cut. The spacers 80, 90 and the metal channels 100, 100' or panel 100' are then removed from the fence. The stressing post 30 can form a triangular pilaster 130 together with two end posts at the corner, or a square pilaster 120 with two end posts and an additional post, as seen in FIG. 3.

Wires 40 and lath 60 can then be added to the pilasters by hand without high tension. The pilasters at the corners of the fence should be coated in the same way as the other fence parts.

The thus-formed fence construction can then be painted with a prime coat or a color coat according to choice.

Figure 10:
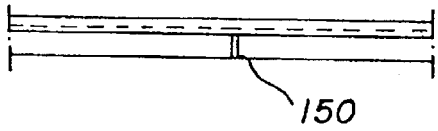
FIG. 10 is a partial view showing a control joint.
Figure 9:
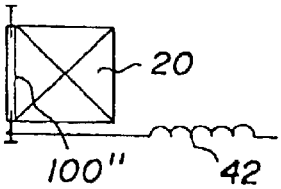
FIG. 9 is a top-plan view of the end fence post, showing the temporary metal panel, nailed on the outer side of the end fence post, with studs for attaching the wires.

To further improve the appearance of the fence, additional wire lath 60 and coating 70 can also be applied on the top of the fence (see FIG. 10). Pre-constructed, non-structural columns 140 can be used as gate posts (see FIGS. 2 and 3).

Figure 11:
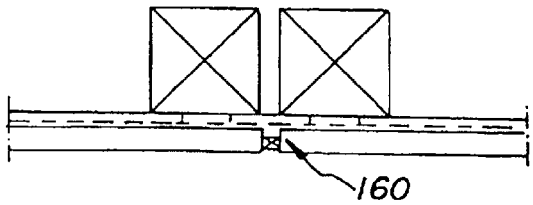
FIG. 11 is a partial view showing an expansion joint.

Crack control joints 150 can be provided between the brown coat and the finish coat (see FIG. 10). Expansion control joints 160 can be provided for very long fence walls or fence walls with corners and/or bends (see FIG. 11).

Figure 15:
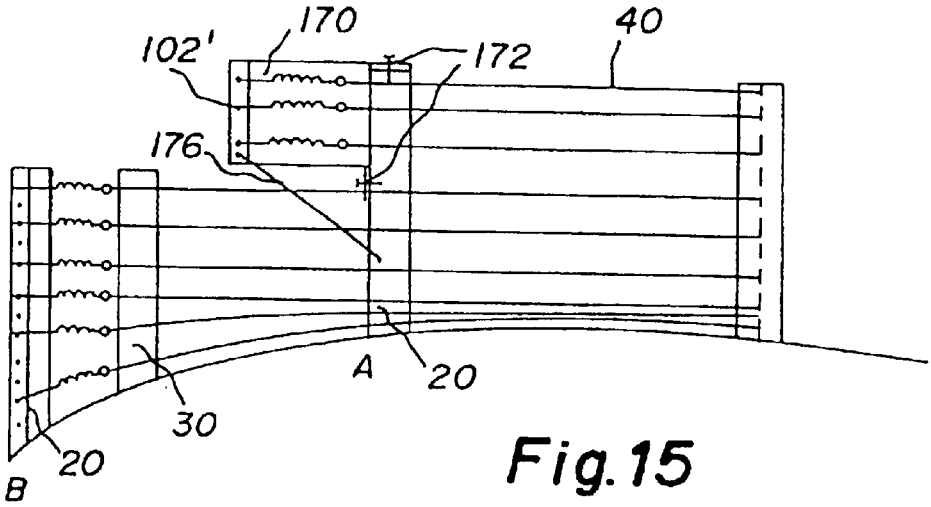
FIG. 15 diagrammatically shows a fence construction system for building a fence on uneven ground with an additional adaptor.
Figure 16:
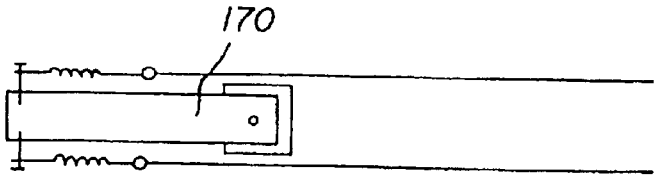
FIG. 16 is a top-plan view of the adaptor as shown in FIG. 15.

FIGS. 15 and 16 illustrate an adapter 170 used to compensate for differences in elevation of the ground on which the fence is placed. If, for example, a rise in the ground level is encountered, a fence post 20 in position A will be higher than a fence post 20 in position B. Therefore, it will be necessary to string additional tensile wires 40 extending from the fence post 20 in position A, in a direction away from position B. The adaptor 170 has studs 102' for stringing the additional tensile wires 40. The adaptor 170 is attached to the fence post 20 by screwing through flanges 172 on the top and on the side of the fence post 20. An additional brace 176 can be used to support the adaptor 170.

Other embodiments of the invention will be apparent to those skilled in the art from consideration of the specification and practice of the invention disclosed herein. It is intended that the specification and examples be considered as exemplary only.

We claim:

1. A method for constructing a fence with a wall appearance and characteristics, which comprises the steps of:

erecting a plurality of fence posts including two end fence posts;

erecting two stressing posts within and closely adjacent the two end fence posts;

placing a respective spacer between each stressing post and the adjacent end post;

stringing a plurality of high-tension tensile wires between the two end posts;

tensioning the high-tension tensile wires;

securing the high-tension tensile wires to the fence posts;

securing wire lath to the pre-stressed high-tension tensile wires and fence posts;

applying fence coating material to the wire lath;

cutting the high-tension tensile wires between the end fence posts and the stressing posts; and removing the spacers.

2. The method according to claim 1, which further comprises providing each high-tension tensile wire with a spring and a tensioner at an end thereof and tensioning the high-tension tensile wires with the tensioners.

3. The method according to claim 2, wherein the spring and the tensioner in each high-tension tensile wire are disposed between at least one of the stressing posts and the adjacent end fence post.

4. The method according to claim 1, which further comprises placing a strip at an outer side of each end post.

5. The method according to claim 4, which further comprises providing the strips with a plurality of studs and stringing the plurality of high-tension tensile wires between the studs.

6. The method according to claim 5, wherein the strips are formed as a metal channel wrapped around the outer side of each end post.

7. The method according to claim 4, wherein the strips are formed as a metal panel placed against the outer side of each end post.

8. The method according to claim 5, wherein the studs are formed on at least one of a front and a back side of the strips.

9. The method according to claim 1, which further comprises cutting the high-tension tensile wires between the stressing posts and the tensioners.

10. The method according to claim 1, which further comprises applying wires and wire lath between the end posts and the stressing posts.

11. The method according to claim 10, which further comprises applying fence coating material to the wire lath between the end posts and the stressing posts.

12. The method according to claim 1, which further comprises forming the stressing posts as pilasters after completion of the fence construction.

13. The method according to claim 1, which further comprises securing the wire lath to the high-tension tensile wires with fastener clips.

14. The method according to claim 1, which further comprises performing the step of applying fence coating material to the wire lath by:

applying a scratch coat to the wire lath;

applying a brown coat to the surface of the scratch coat; and applying a finish coat to the surface of the brown coat.

15. The method according to claim 14, which further comprises providing crack control joints between the brown coat and the finish coat.

16. The method according to claim 1, which further comprises providing expansion joints for long fence walls or fence walls with corners/bends.

17. A fence construction system, comprising:

a plurality of fence posts including end fence posts;

at least two stressing posts both disposed between said end fence posts and each disposed closely adjacent a respective one of said end fence posts;

a removable spacer provided between the end fence posts and the adjacent stressing posts;

a plurality of high-tension tensile wires running between and secured to said end fence posts;

a tensioner disposed at each high-tension tensile wire for tensioning said high-tension tensile wires;

a wire lath secured to said plurality of high-tension tensile wires and said fence posts; and said high-tension tensile wires being cut between said end fence posts and said stressing posts compressing said wire lath.

18. The fence construction system according to claim 17, further comprising strips each disposed against said outer side of a respective one of said stressing posts.

19. The fence construction system according to claim 18, wherein said strips having a plurality studs formed thereon, said studs extending perpendicularly to a fence surface.

20. The fence construction system according to claim 18, wherein said strips are formed as a metal channel wrapped around an outer side of each stressing post.

21. The fence construction system according to claim 20, wherein said strips are U-shaped.

22. The fence construction system according to claim 20, wherein said strips are L-shaped.

23. The fence construction system according to claim 18, wherein said strips are formed as a metal panel placed against an outer side of each stressing post.

24. The fence construction system according to claim 21, further comprising a strengthening bar attached between said U-shaped channel and said spacer.

25. The fence construction system according to claim 24, wherein said strengthening bar has two notches for attaching to a stud on said U-shaped channel and a stud on said spacer.

26. The fence construction system according to claim 17, wherein said spacer is a rectangular metal frame.

27. The fence construction system according to claim 16, wherein said spacer is a metal plate with two flanges.

28. The fence construction system according to claim 27, wherein said metal plate further has a supporting bar attached thereto.

29. The fence construction system according to claim 17, further comprising a fence coating applied to said wire lath, said cut high-tension tensile wires compressing said fence coating together with said wire lath.

30. The fence construction system according to claim 29, wherein said fence coating includes a scratch coat applied to said wire lath, a brown coat applied to said scratch coat and a finish coat applied to said brown coat.

31. The fence construction system according to claim 29, further comprising a paint applied on said fence coating.

32. The fence construction system according to claim 31, wherein said paint is one of a prime coat and a color coat.

33. The fence construction system according to claim 17, further comprising an adaptor attached to an upper part of a higher fence post upon an elevation difference occurring between said fence posts.

34. The fence construction system according to claim 33, wherein said adaptor has plurality of studs for attaching said high-tension tensile wires and is attached to said fence post.

* * * * *